US006991552B2

(12) United States Patent
Burke

(10) Patent No.: US 6,991,552 B2
(45) Date of Patent: Jan. 31, 2006

(54) SWING MONITORING DEVICE

(76) Inventor: Thomas J. Burke, 5 Matheson Rd., Whitehouse Station, NJ (US) 08889

( * ) Notice: Subject to any disclaimer, the term of this patent is extended or adjusted under 35 U.S.C. 154(b) by 237 days.

(21) Appl. No.: 10/133,790

(22) Filed: Apr. 25, 2002

(65) Prior Publication Data

US 2002/0160848 A1 Oct. 31, 2002

Related U.S. Application Data

(63) Continuation-in-part of application No. 09/436,582, filed on Nov. 9, 1999, now Pat. No. 6,413,167, which is a continuation-in-part of application No. 09/133,236, filed on Aug. 13, 1998, now Pat. No. 6,012,988.

(51) Int. Cl.
*A63B 69/36* (2006.01)

(52) U.S. Cl. ..... 473/213; 473/221; 473/233; 473/458; 434/252

(58) Field of Classification Search ..... 473/207, 473/212, 213, 221, 223–224, 233–234, 256–258; 463/3

See application file for complete search history.

(56) References Cited

U.S. PATENT DOCUMENTS

| | | | | |
|---|---|---|---|---|
| 1,549,350 A | | 8/1925 | Deike | |
| 2,064,603 A | | 12/1936 | Harrison | |
| 2,191,683 A | | 2/1940 | Roberts | |
| 2,388,463 A | | 11/1945 | Benecke | |
| 3,717,857 A | * | 2/1973 | Evans | 340/870.13 |
| 3,730,530 A | | 5/1973 | Oka et al. | |
| 3,776,556 A | | 12/1973 | McLaughlin | |
| 3,808,707 A | | 5/1974 | Fink | |
| 3,860,245 A | * | 1/1975 | Yamada | 473/213 |
| 4,283,057 A | | 8/1981 | Ragan | |
| 4,699,379 A | * | 10/1987 | Chateau et al. | 473/59 |
| 4,898,389 A | | 2/1990 | Plutt | 273/186 A |
| 4,991,850 A | * | 2/1991 | Wilhlem | 473/233 |
| 5,082,283 A | | 1/1992 | Conley et al. | 273/186 A |
| 5,165,683 A | | 11/1992 | Beutler et al. | |
| 5,184,826 A | | 2/1993 | Hall, Jr. | 273/186.2 |
| 5,236,192 A | | 8/1993 | Pitzel | |
| 5,259,620 A | * | 11/1993 | Morocco | 473/224 |
| 5,419,562 A | | 5/1995 | Cromarty | 273/183 |
| 5,435,561 A | | 7/1995 | Conley | 273/186.2 |
| 5,588,919 A | * | 12/1996 | Nakamura | 473/212 |
| 5,607,361 A | * | 3/1997 | Mastandrea et al. | 473/207 |
| 5,792,000 A | * | 8/1998 | Weber et al. | 473/223 |
| 5,871,406 A | * | 2/1999 | Worrell | 473/221 |
| 6,012,988 A | | 1/2000 | Burke | 473/224 |
| 6,196,932 B1 | | 3/2001 | Marsh et al. | 473/223 |
| 6,224,493 B1 | * | 5/2001 | Lee et al. | 473/223 |
| 6,648,769 B2 | * | 11/2003 | Lee et al. | 473/223 |

* cited by examiner

*Primary Examiner*—Chanda L. Harris
*Assistant Examiner*—Alex F. R. P. Rada, II
(74) *Attorney, Agent, or Firm*—Lerner, David, Littenberg, Krumholz & Mentlik, LLP

(57) ABSTRACT

An overswing alerting mechanism/swing monitoring device that a user can wear, for example on the wrist, hand or arm, that can determine swing formation, and that can display and/or store the determined swing information. As an option, the device includes a visual and/or audible indicator for alerting the user to an improper swinging motion.

16 Claims, 6 Drawing Sheets

SWING MONITORING DEVICE

CROSS-REFERENCE TO RELATED APPLICATIONS

This application is a continuation-in-part application of U.S. patent application Ser. No. 09/436,582, which was filed on Nov. 9, 1999 U.S. Pat. No. 6,413,167 and which is a continuation-in-part of U.S. patent application Ser. No. 09/133,236, which was filed on Aug. 13, 1998 U.S. Pat. No. 6,012,898, both Ser. Nos. 09/436,582 and 09/133,236 being hereby incorporated by reference.

FIELD OF THE INVENTION

The present invention relates to the field of aids for assisting a person in obtaining a proper swinging movement of sports articles, such as a golf club, baseball bat, hockey stick, tennis racket and the like; and more particularly, relates to an overswinging alerting mechanism for use with such articles which generates a visual and/or audible indicator for the purpose of alerting the person to an improper swinging movement.

BACKGROUND OF THE INVENTION

In the past, various devices have been employed to indicate an improper swinging movement of clubs, bats, rackets, sticks and the like so that the person swinging the object can refine his/her swing. Devices for helping golfers hone their swings have received particular attention. For instance, in U.S. Pat. No. 1,549,350 to Deike issued Aug. 11, 1925, a whistle is either secured within a recess of the golf club head (see FIG. 4 of Deike) or extended from the top of the golf club head (see FIG. 5 of Deike). This whistle produces the loudest sound at the point of greatest speed of the golf club, which Deike contends should occur at the time of contact of the golf club head with the golf ball. It has been found, however, that the proper golf swing is not necessarily purely dependent upon striking the golf ball at the maximum speed of the golf club.

In U.S. Pat. No. 4,283,057 to Ragan issued Aug. 11, 1981, a golf club is provided with an air flow hole through its head which contains a whistle which according to Ragan provides an indication of the smoothness and velocity of the swing based upon the turbulence of the ambient air at the air flow hole's outlet head. However, due to variables which determine air turbulence, such as wind gusts, etc., it has been found desirable to provide an overswing alerting mechanism which is not dependent upon the air turbulence of the ambient air.

Moreover, since the whistle in Ragan is provided in an air flow hole in the golf club head, the Ragan golf club can only be utilized as a golf practice device unless the Ragan club head employs a second whistle 6 which is provided in hole 12 and the first hole 4 and whistle 5 are eliminated as is shown in FIG. 5 of Ragan. In this embodiment, Ragan contends that sound output may be adequate in some instances if the upper end of the shaft is left open to provide an adequate flow of pressurized air. However, Ragan concedes that this golf club swing trainer will only provide a sound output that may be adequate in some instances, particularly when the golf club is swung in the absence of excessive background noise. However, in view of the many conditions in which golf is played, it has been found desirable to provide an overswing alerting mechanism which is not dependent upon the presence or absence of background noise.

In U.S. Pat. No. 3,730,530 to Oka et al. issued May 1, 1973, a golf swing training attachment is attached by a suction disk to the golf club head wherein a vibration plate emits a sound when the club head reaches a desirable speed. However, in view of the speed of swing of the golf club, such attachments have been found to fly off the golf club. Therefore, it has been found desirable to provide an overswing alerting mechanism for a golf club which is permanently mounted on or incorporated within a golf club, or which is detachably affixed to the club so as to provide an overswing alert without flying off the club during a swing.

In U.S. Pat. No. 3,776,556 to McLaughlin issued Dec. 4, 1973, an attachment is externally mounted on the golf club shaft which includes a pair of differently oriented and pitched whistles which McLaughlin contends do not emit a sound when the swing of the golf club is perpendicular to the club face but will emit differing sounds when there is a hook or a slice. However, the generation of sounds from the two whistles is only dependent upon the angle of the golf club face with respect to the intended swinging direction of the golf club. Accordingly, the McLaughlin golf club practice aid does not produce an audible sound merely upon the occurrence of an overswing condition.

Moreover, the United States Golf Association ("USGA") promulgates and administers the Rules of Golf in the United States. It is believed that each of the golf club practice devices mentioned above does not comply with at least one of the USGA's rules relating to improper equipment. For instance, the USGA Rules of Golf provide that, in general, the club must not have any external attachments (see USGA Rules of Golf 1998–1999, §4-1a). Therefore, it is believed that the golf club practice aids of U.S. Pat. No. 3,730,530, U.S. Pat. No. 3,776,556 and the aid of FIG. 6 of U.S. Pat. No. 1,549,350 do not comply with at least this USGA Rule. In addition, the USGA Rules of Golf provide that the club head cannot have holes therethrough as it must be generally plain in shape (see USGA Rules of Golf 1998–1999 §4-1d and App. II, §4-1d). Therefore, it is believed the golf club practice aids of U.S. Pat. No. 4,283,057 and the aid of FIGS. 1–4 of U.S. Pat. No. 1,549,350 do not comply with at least this USGA Rule. Under the USGA Rules of Golf, penalties, such as penalty strokes, etc., result from use of improper equipment. It has therefore been found desirable to provide an overswing alerting mechanism for a golf club which is believed to be in compliance with the current USGA Rules of Golf.

SUMMARY OF THE INVENTION

It has been recognized that it is desirable to provide an overswing alerting mechanism for a golfer which avoids the aforementioned disadvantages of the prior art. It has been further recognized that it is desirable to provide an overswing alerting mechanism/swing monitoring device that people can use to refine their swings in various sports, such as golf, baseball, tennis, hockey, etc., and which can be applied to the various sports without modification.

Accordingly, the present invention provides an overswing alerting mechanism/swing monitoring device that a user can wear, for example on the wrist, hand or arm, that can determine swing information, and that can display and/or store the determined swing information. As an option, the device includes a visual and/or audible indicator for alerting the user to an improper swinging motion.

BRIEF DESCRIPTION OF THE DRAWINGS

The following detailed description, given by way of example, will best be understood in conjunction with the accompanying drawing in which.

DETAILED DESCRIPTION OF CERTAIN PREFERRED EMBODIMENTS OF THE INVENTION

Figure 1:
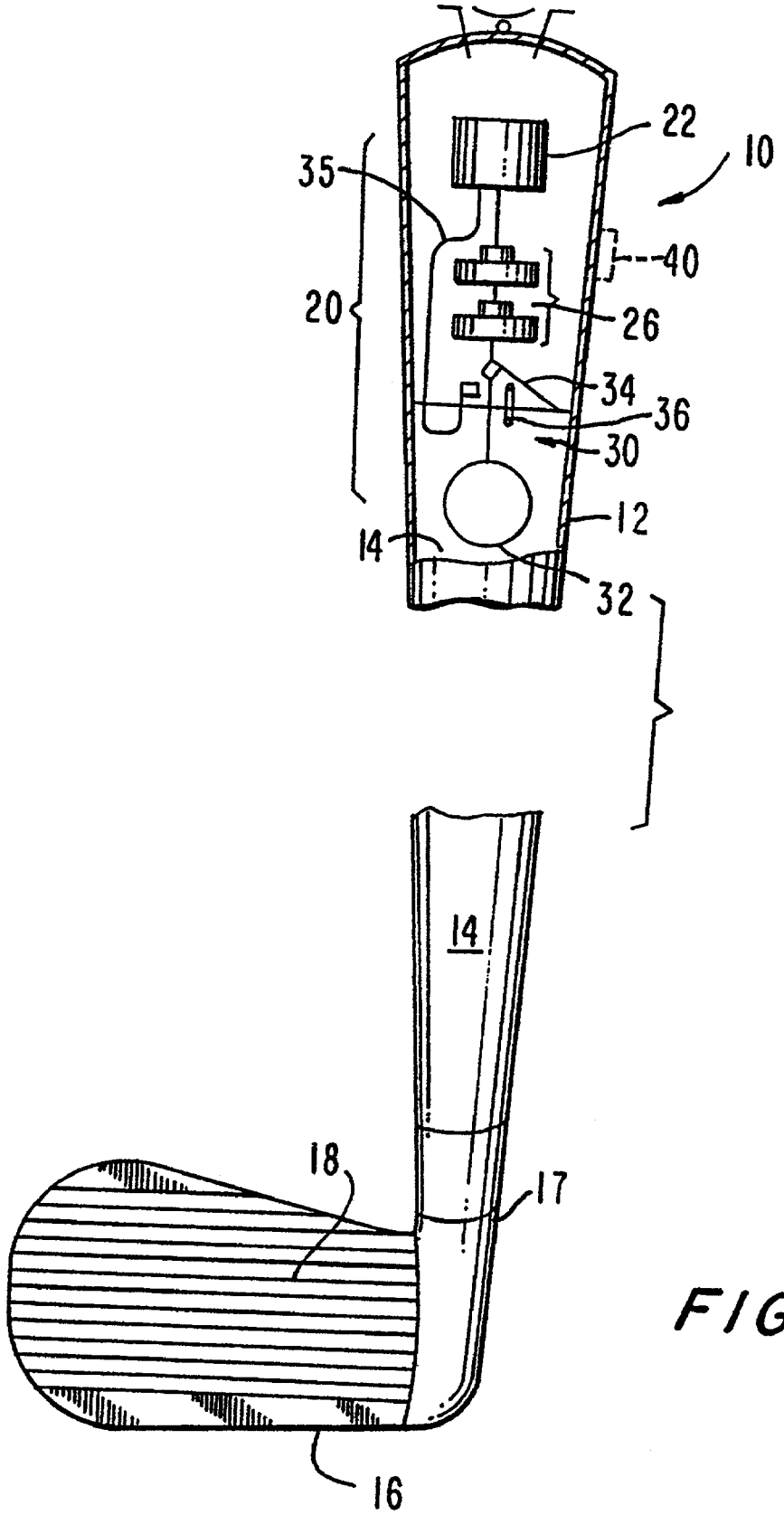
FIG. 1 is a front elevational view in cross-section of a preferred embodiment of a golf club with overswing alerting mechanism in accordance with the teachings of the present invention.

Referring now to the drawings, there is illustrated a preferred embodiment of a golf club having an overswing alerting mechanism in accordance with the present invention. As is described below, this golf club with overswing alerting mechanism produces an audible sound upon the occurrence of an overswing condition of the golf club.

As is shown in FIG. 1, the golf club 10 of the present invention generally includes a golf club shaft 12 having a hollow opening 14 extending therethrough for the length thereof and a golf club head 16 supported on an end 17 of the golf club shaft 12 with the golf club head 16 having a striking face 18 for hitting the golf ball.

Figure 3:
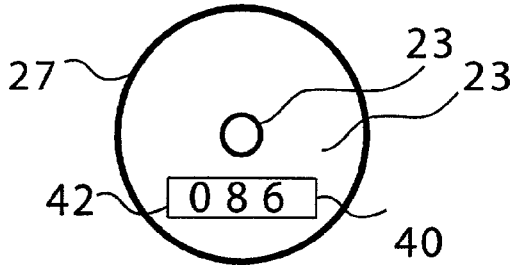
FIG. 3 is a top view of the grip butt with LCD readout which can be incorporated in the golf club with overswing alerting mechanism of FIGS. 1 and 2.

In order to alert the golfer that the golf club has been overswung, an overswing alerting mechanism, generally referred to by reference numeral 20 in FIG. 1, is permanently incorporated within the golf club 10 of the present invention. In order to prevent the overswing alerting mechanism 20 from altering the golfer's swing, the overswing alerting mechanism 20 of the present invention is housed entirely within the hollow opening 14 of the golf club shaft 12. As is shown in FIG. 3, the sound of the horn can be heard through the standard central opening 23 provided in the grip butt 25 of the grip 27 fit over the top end of the golf club shaft 12.

As is shown in FIG. 1, the overswing alerting mechanism 20 includes a sound generation assembly 22 for generating an audible sound upon the occurrence of an overswing condition. In the preferred embodiment, the sound generation assembly 22 is in the form of a horn but it can be any electrically-operated device which can emit an audible sound. As is shown in FIG. 1, the sound generation assembly 22 is sized to fit within the hollow opening 14 of the golf club shaft 12.

In order to provide electrical energy to the sound generation assembly 22, an energy generation member 26 is electrically connected thereto and supported within the hollow opening 14 of the golf club shaft 12. In the preferred embodiment, the energy generation member 26 is in the form of two 1½ volt hearing aid batteries. However, any power supply which can be sized to be accommodated within the hollow opening 14 of the golf club shaft 12 and still provide sufficient electrical power to the sound generation assembly 22 may be employed.

As is shown in FIG. 1, the overswing alerting mechanism 20 for a golf club of the present invention also includes a circuit activating or closing member 30 provided in the hollow opening 14 of the golf club shaft 12 which activates the energy generation member 26 only upon the occurrence of an overswing condition. More particularly, this circuit closing member 30 includes a weight member 32 which, upon the occurrence of an overswing condition, closes a contact member 34, which in turn, contacts a contact adjustment screw/switch 36 which is electrically connected to the sound generation assembly 22 by means of electrical wiring 35. Accordingly, the electrical circuit between the energy generation member 26 and the sound generation assembly 22 is closed to thereby generate an audible sound from the sound generation assembly 22. As shown in FIG. 1, the weight member 32 and contact member 34 are positioned within the hollow opening 14 of the golf club shaft 12 so that the weight member 32 will only close the contact member 34, and thus close the electrical circuit between the energy generation assembly 26 and the sound generation assembly 22, if the golf club is overswung.

Figure 2:
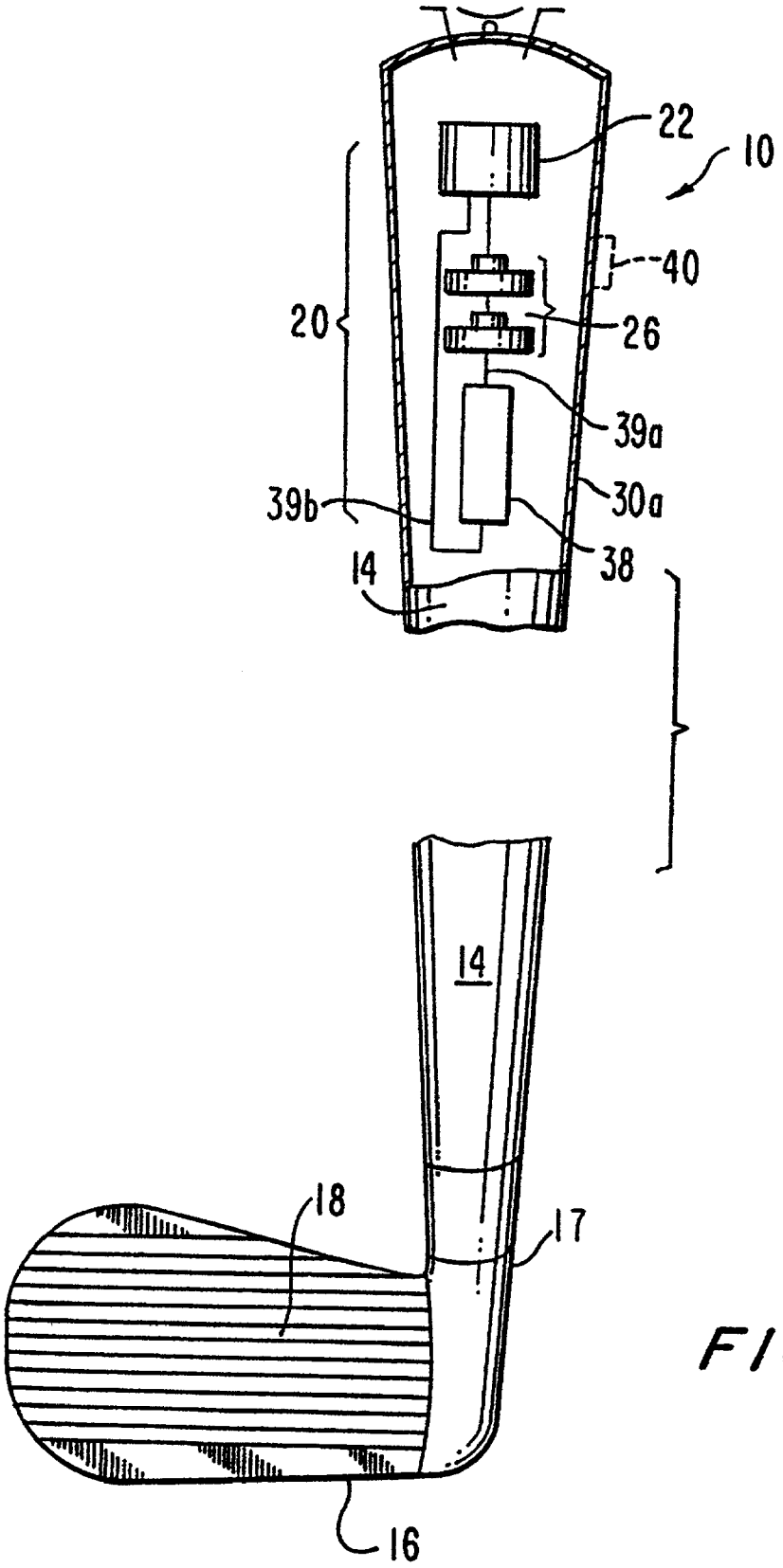
FIG. 2 is a front elevational view in cross-section of another preferred embodiment of a golf club with overswing alerting mechanism in accordance with the teachings of the present invention.

Another preferred embodiment of the circuit closing member for the overswing alerting mechanism for a golf club of the present invention is shown in FIG. 2. In this embodiment, the circuit closing member 30*a* includes an electronic transducer 38 which is electrically connected between the energy generation member 26 and the sound generation assembly 22 by means of electrical wiring 39*a* and *b*. Upon sensing an overswing condition of the golf club, the electronic transducer 38 closes the electrical circuit such that an audible sound is generated by the sound generating assembly 22.

In a further embodiment of the present invention, as is shown in FIG. 3, an LCD readout 40 can be provided in a recess 42 of the grip butt end 23. This recess 42 extends appropriately ¼"×½" inwardly from the top end of the grip butt end 23. The LCD readout 40 indicates in miles per hour the speed of the golf club shaft.

Figure 4:
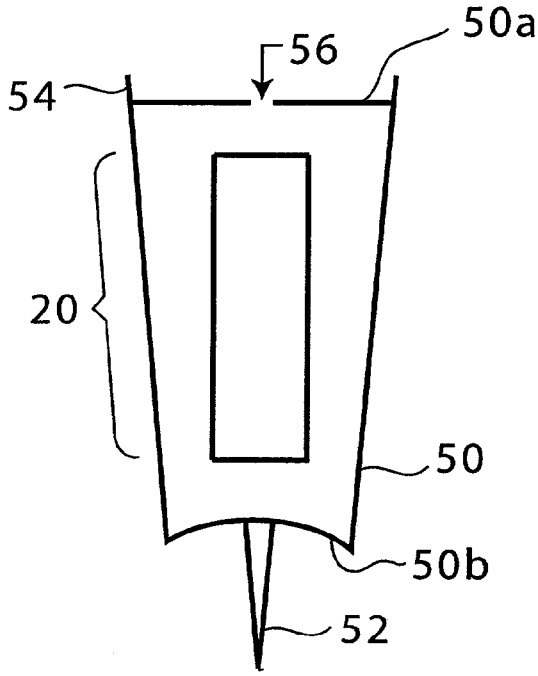
FIG. 4 is a cross-section view of an alternative embodiment of a golf club with overswing alerting mechanism in accordance with the teachings of the present invention.
Figure 5:
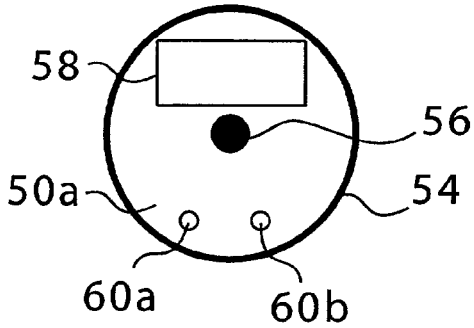
FIG. 5 is a top view of the alerting mechanism housing depicted in FIG. 4.

An alternative embodiment of the invention is shown in FIGS. 4 and 5. As can be seen from FIG. 4, in the alternative embodiment, the overswing alerting mechanism 20 is positioned within a housing 50 that may be generally cylindrical or conical in shape—although it is not limited to such shapes. The housing includes two "end surfaces" 50*a* and 50*b*, end surface 50*a* having a through hole 56, and end surface 50*b* being fixed to a projection 52. The through hole 56 is provided for allowing sound projected by the overswing mechanism's sound generation unit (element 22 in FIGS. 1 and 2) to exit the housing uninhibited. Projection 52 is provided for detachably attaching the housing to the butt end of a golf club. That is, the projection is inserted into a standard central opening of a grip butt like the opening 23 and butt 25 described in relation to FIGS. 1–3.

Further, as can be noted from FIG. 4, end surface 50*b* is concave in shape in order to more securely adjoin the butt end of a golf club, and end surface 50*a* includes a protective lip 54 projecting upward from the surface.

FIG. 5 shows the outside of the housing of FIG. 4 as viewed by looking down on surface 50*a*. As can be seen from FIG. 5, surface 50*a* is generally circular in shape, and therefore lip 54 which runs along the perimeter of the surface is also generally circular in shape. As further shown, a display 58 and buttons 60*a* and 60*b* are positioned within surface 50*a*. The lip, which projects approximately ⅛" above surface 50*a*, is provided primarily to protect display 58 and buttons 60*a*, 60*b* from direct impact with the ground and other objects. The display is used, for example, to display a golfer's swing speed, while the buttons may be respectively used, for example, to turn the mechanism on and off and to set the swing speed at which the alarm should be activated. Some alternative uses of the display and buttons are described below with respect to FIG. 6.

Figure 6:
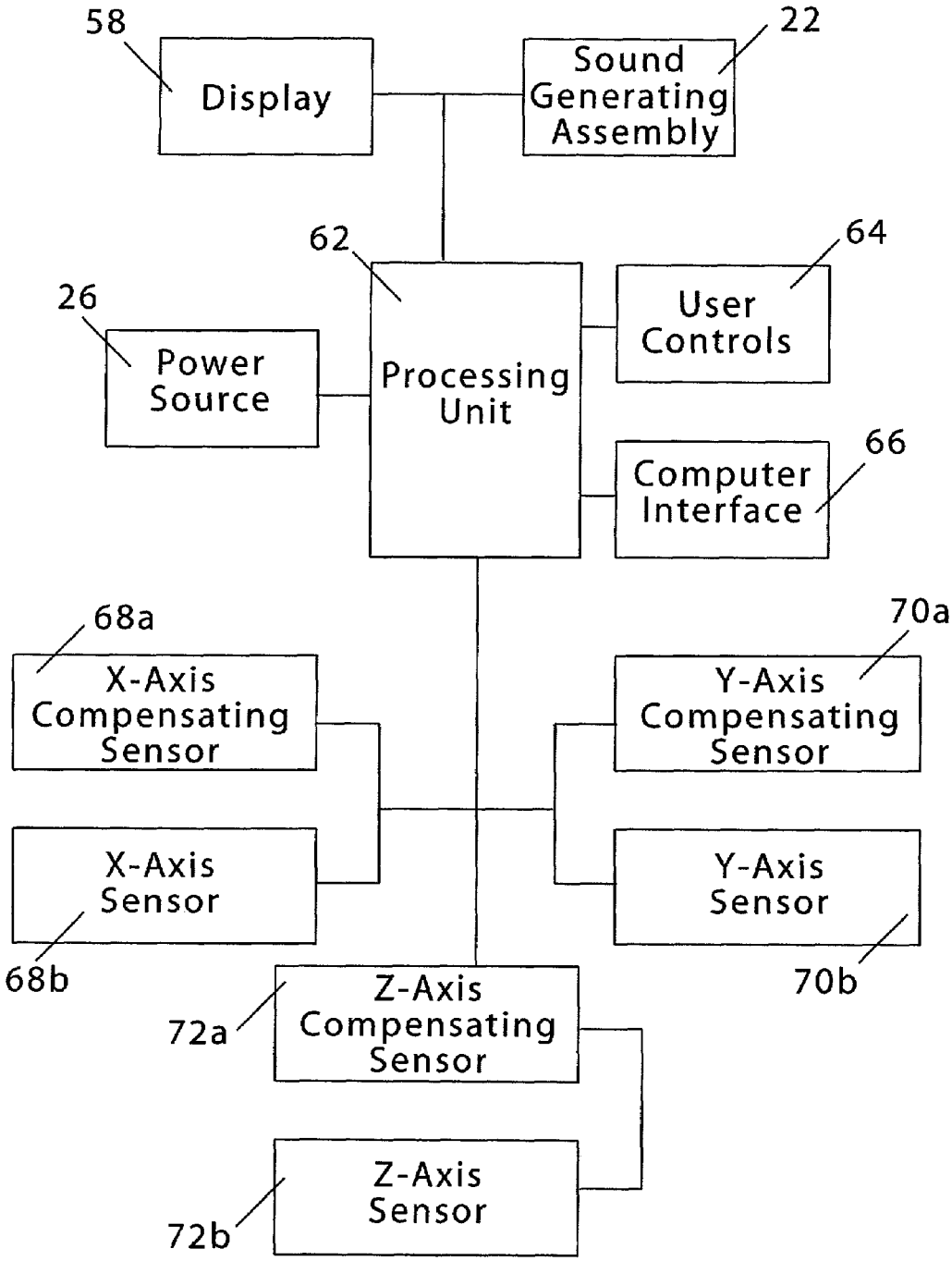
FIG. 6 is a block diagram representation of a preferred embodiment of the alerting mechanism of the invention.

FIG. 6 is a block diagram representation of a preferred embodiment of the alerting mechanism of the invention. The alerting mechanism of FIG. 6 includes a multiple of sensors 68*a*, 68*b*, 70*a*, 70*b*, 72*a* and 72*b* and a processing unit 72, in addition to the previously described power source 26, sound generation assembly 22 and display 58. A set of user controls 64 and a computer interface are also included, the user controls referring, for example, to buttons 60*a* and 60*b* of FIG. 5, and the computer interface being provided for coupling of the mechanism to an external computer/processor.

Each sensor of FIG. 6 is capable of measuring force applied to the alerting mechanism along a particular axis. Thus, for example, sensor 68*a* is an accelerometer which measures the force applied to the mechanism along the X-axis of the three dimensional reference system. Similarly sensors 70*a* and 72*a* may be accelerometers which respectively measure Y-axis and Z-axis forces. In one possible application, sensors 68*a*, 70*a* and 70*b* operate to measure three-dimensional force components acting on the mechanism during a golf swing and pass the measurements to the processing unit which derives an indication of the swing speed from the measurements. It should be noted, however, that the use of three sensors is not required for generation of a swing speed indication. Any one of the sensors 68*a*–72*b*, or any combination of the sensors 68*a*–72*b*, can be used to provide a swing speed indication. Of course, the number of sensors which can be used is not limited to six.

Regardless of the number of sensors employed, the data from the sensors is processed and/or stored in the processing unit 62. In the configuration depicted in FIG. 6, two sensors are employed for each axis of motion and processing the data from each axis involves a differential calculation. That is, in order to convert axial g-forces to actual club head speed, one must employ two sensors per axis and measure the differential g-force on the sensors.

In any event, the data processed/stored in the processor can be used to generate an indicator of club head speed suitable for viewing on display 58 and/or suitable for triggering the alarm of the sound generating assembly 22. Furthermore, the processing unit may be coupled to a computer via computer interface 66 so that sensor data stored in the processing unit can be downloaded to the computer for further analysis. For example, data from sensors 68*a*-72*b* may be used by a computer to construct a graphical representation of a golfer's entire swing.

Based upon the foregoing it will be appreciated that the golf club with overswing alerting mechanism of the present invention generates an audible sound upon occurrence of an overswing condition. Moreover, the generation of the audible sound of the overswing alerting mechanism of the present invention is not purely dependent upon the speed at which the golf ball is struck by the golf club as instead an audible sound is generated if the golf club is overswung.

Further, since the overswing alerting mechanism of the present invention is not in the form of a whistle, it is not dependent upon the air turbulence of the ambient air.

Moreover, it is believed that the preferred embodiments of a golf club with overswing alerting mechanism of the present invention set forth above comply with the current USGA Rules of Golf relating to golf equipment. That is, in order to make the golf club with overswing alerting mechanism of the present invention suitable for both practice and play, the mechanism is permanently incorporated within the golf club. In this regard, the mechanism is not externally attached, as it is entirely housed within the hollow opening 14 of the golf club shaft, and in addition, the club head remains generally plain in shape (i.e., it requires no holes through the club head). Alternatively, the overswing alerting mechanism is accommodated within a housing that can be detachably affixed to a golf club so that the mechanism can be attached to the club during practice and detached during play under USGA rules.

In a further embodiment, as shown in the dotted line in FIG. 1, an on-off switch 40 can be attached to the golf club shaft 12 for activating and deactivating the overswing alerting mechanism 20 when desired.

In still another embodiment, one or more accelerometers are included within the alerting mechanism 20, the data from these accelerometers being used to provide overswing indication and being downloadable to a processor and/or memory external to the mechanism.

Figure 7:
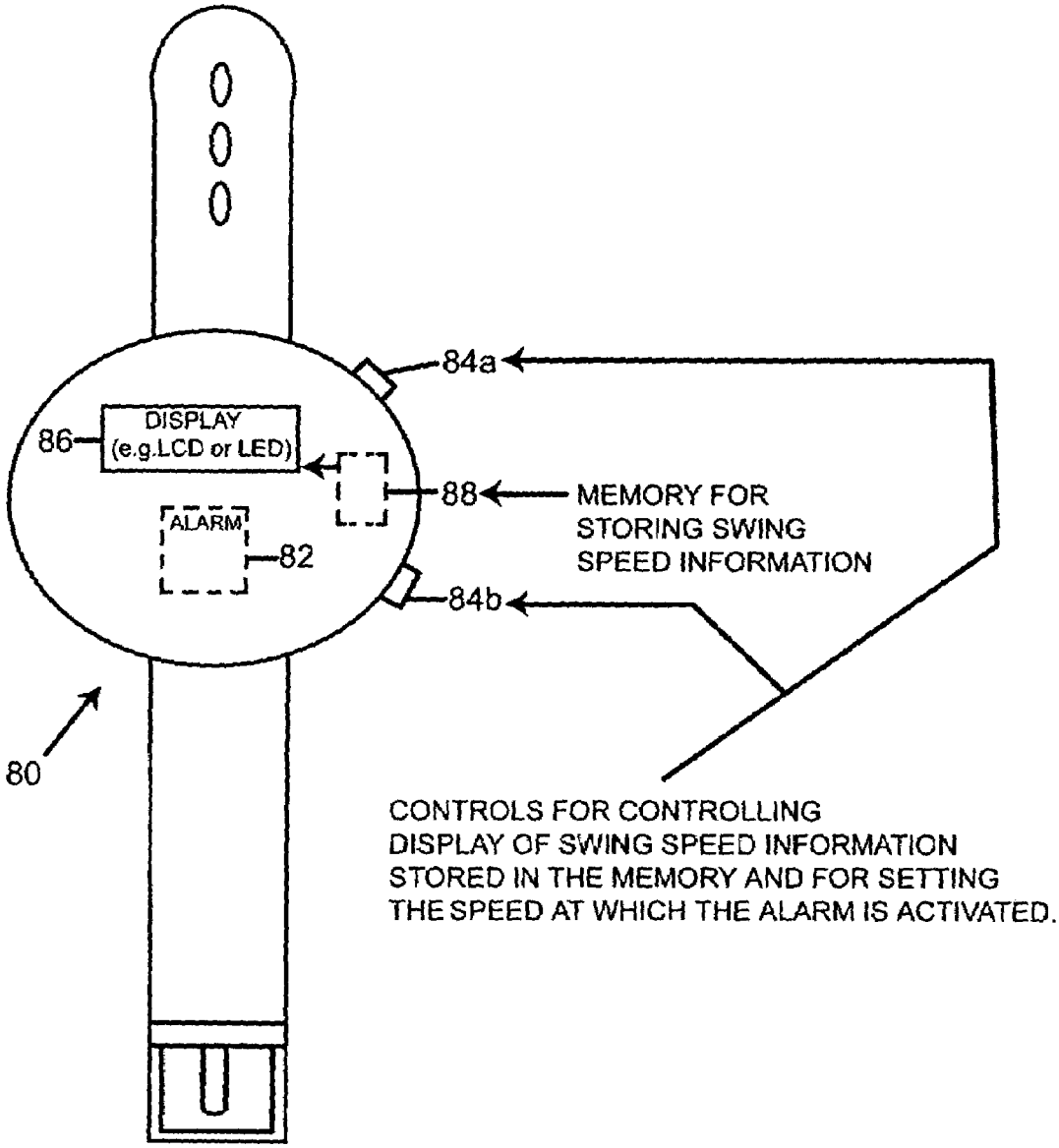
FIG. 7 shows a wristwatch embodiment of a swing monitoring device in accordance with the present invention.

Yet another embodiment of the present invention is shown in FIG. 7. In the embodiment of FIG. 7, the invention is implemented as a wristwatch-type swing monitoring device 80. The wristwatch type device includes an overswing alerting mechanism 82 such as the alerting mechanism 20 included in FIG. 1 or the alerting mechanism depicted in FIG. 6. The device further includes control buttons 84*a* and 84*b*, display 86 and memory 88. Button 84*a* is used to turn the device on and off while button 84*b* is used to set a swing speed at which an alarm is activated and/or to display swing speed information. Display 86 is used to display the speed of the user's swing, and may be a light emitting diode (LED) display or liquid crystal display (LCD) display like that shown in FIG. 3. Memory 88 is used to store swing speed information.

In a preferred embodiment, a multiple of swing speeds are stored in the memory and are called up by the user through use of control button(s) 84*a* and/or 84*b*. For example, the speeds of the last 64 user swings are stored in the memory and the user presses and holds one or both of buttons 84*a* and 84*b* to observe a sequential display of the speeds, the speeds being passed from the memory to the display and being displayed at a fixed time intervals. In another example, display 86 can be used to provide a scrolling display of listed swing speeds, with button 84*a* being used to scroll up through the list and button 84*b* being used to scroll down through the list.

In a related embodiment, button 84*a* is a Program button and button 84*b* is a Power On button. The Program button and Power On button are used to implement four primary functions, calibrating, clearing memory, displaying and setting alarm threshold.

To perform calibration of the swing monitoring device, a user holds the device so that the display 86 is facing up, parallel with the floor. With the device turned off, the user presses and holds the Program button. While holding the Program button, the user turns on the device by momentarily pressing the Power on button, the device beeps. While holding the Program button the user hears: beep (pause) beep (pause) beep beep beep. The user releases the Program button after the three beeps. The alerting mechanism is now calibrated.

To clear the memory 88, with the device turned off, the user presses and holds the Program button. While holding the Program button, the user turns on the device by momentarily pressing the Power On button, the device will beep. After the initial beep tone, there will be a pause followed by a second beep. The user releases the Program button. The swing memory is now cleared.

To display the swing information on display 86, with the device turned on, the user presses and holds the Program button. The device will beep, and shortly after beep a second time. The user releases the Program button after the second beep. The display will now sequentially show the last 64 swing values. To abort the swing display, the user powers the device off and then back on.

To set the alarm threshold, with the device turned on, the user presses and holds the Program button. While holding the Program button the user hears: beep (pause) beep (pause) beep (pause) beep beep beep. The user releases the Program Button after the three beeps. The alarm threshold is now set.

It should be noted that many variations of the wristwatch-type embodiment and its control and display functions will be obvious to one skilled in the art in view of this disclosure.

In particular, it should be noted that, as an alternative to implementing the invention as a dedicated wristwatch-type device, the invention may be integrated into a conventional wristwatch. Thereby, a user can simultaneously enjoy the functionality of the invention and the functionality of a traditional wristwatch. In a wristwatch-integral implementation, the controls and display for the swing monitoring functions may be distinct from the controls and display for the traditional wristwatch functions; or the controls and display for the swing monitoring functions may be combined with the controls and display for the traditional wristwatch functions, enabling the use of one set of controls and one display for both sets of functions.

The wristwatch-type device depicted in FIG. 7 may be used by players of any sport that involves swinging of the arm, wrist and/or hand without modifying the device on a sport-by-sport basis. For instance, persons wearing the device can use it to monitor their golf swing and then use it to monitor their tennis swing without changing the device in any way. Further, it is noted that while the device has been disclosed as a wrist-mountable device, it could alternatively be designed for mounting on users' arms or hands. Also the device could be designed for mounting on a users' legs to monitor, for example, soccer kick speed or leg speed during running.

Figure 8:
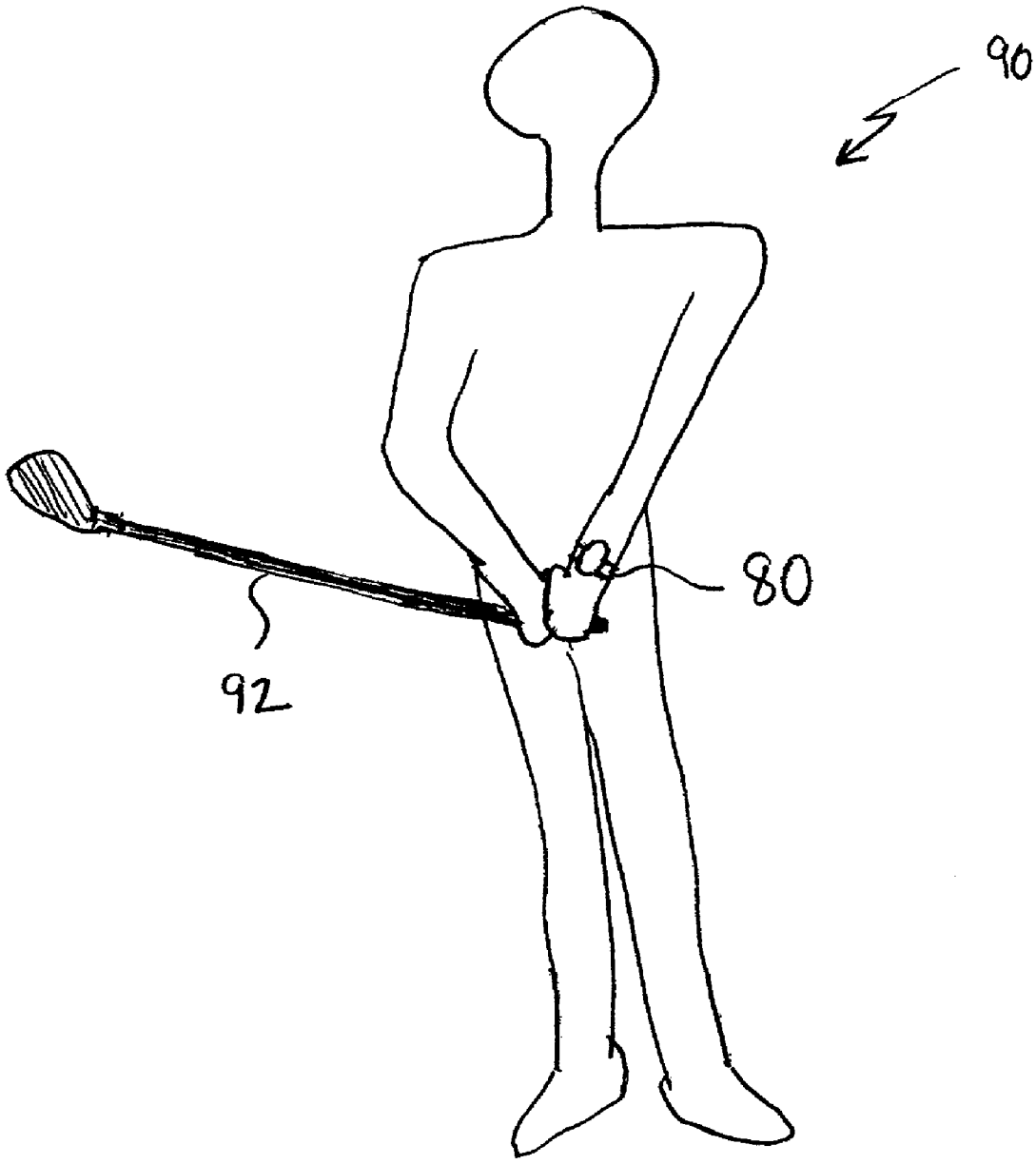
FIG. 8 depicts a golf application of the device shown in FIG. 7.

FIG. 8 depicts one possible application of the wristwatch-type embodiment of the invention. In FIG. 8, a golfer 90 is wearing device 80 on the wrist in order to monitor swing speed when swinging golf club 92.

While the present invention has been particularly shown and described with the reference to certain preferred embodiments, it will be readily apparent to those of ordinary skill in the art that various changes and modifications may be made therein without departing from the sprit and scope of the invention. It is intended that the appended claims be interpreted as including the foregoing as well as various other such changes and modifications.

What is claimed is:

1. A swing monitoring apparatus, comprising:

a mechanism capable of determining swing information which includes an indicator of speed for each of a plurality of individual swings so as to provide a plularity of indicators;

a display capable of displaying at least a portion of said swing information;

means for causing sequential display of the indicators to be initiated; and a wristwatch-type mounting for enabling said mechanism, said display, and the causing means to be coupled to a user's wrist, said mechanism being capable of obtaining an indication of swing speed independent of any switches and sensors external to said apparatus.

2. A swing monitoring apparatus according to claim 1, wherein said display is a Liquid Crystal Display (LCD) display.

3. A swing monitoring apparatus according to claim 1, wherein said display is a Light Emitting Diode (LED) display.

4. A swing monitoring apparatus according to claim 1, further comprising a memory for storing at least a portion of said swing information.

5. A swing monitoring apparatus according to claim 1, further comprising means for causing a scrolling display of said indicators to be initiated.

6. A swing monitoring apparatus according to claim 1, further comprising an alarm for indicating an overswing condition and means for setting a speed at which said alarm is activated.

7. A swing monitoring apparatus according to claim 1, wherein said mechanism and said wristwatch-type mounting are integrated with traditional wristwatch functions.

8. A swing monitoring apparatus according to claim 1, wherein said mechanism comprises at least one accelerometer and a processing unit.

9. A wristwatch having an integral swing monitoring apparatus, comprising:

a mechanism capable of determining swing information which includes an indicator of speed for each of a plurality of individual swings;

a display capable of displaying at least a portion of said swing information;

means for causing sequential display of the indicators to be initiated; and a wristwatch-type mounting for enabling the wristwatch along with said mechanism, said display, and the causing means to be coupled to a user's wrist;

said mechanism being capable of obtaining an indication of swing speed independent of any switches and sensors external to said apparatus.

10. A wristwatch according to claim 9, wherein said display is a Liquid Crystal Display (LCD) display.

11. A wristwatch according to claim 9, wherein said display is a Light Emitting Diode (LED) display.

12. A wristwatch according to claim 9, further comprising a memory for storing at least a portion of said swing information.

13. A swing monitoring apparatus according to claim 12, wherein said display displays the at least a portion of said swing information stored in said memory.

14. A wristwatch according to claim 13, further comprising means for causing a scrolling display of said indicators to be initiated.

15. A wristwatch according to claim 9, further comprising an alarm for indicating an overswing condition and means for setting a speed at which said alarm is activated.

16. A wristwatch according to claim 9, wherein said mechanism comprises at least one accelerometer and a processing unit.

* * * * *

UNITED STATES PATENT AND TRADEMARK OFFICE

CERTIFICATE OF CORRECTION

PATENT NO. : 6,991,552 B2
APPLICATION NO. : 10/133790
DATED : January 31, 2006
INVENTOR(S) : Thomas J. Burke It is certified that error appears in the above-identified patent and that said Letters Patent is hereby corrected as shown below:

Column 8, line 52 between "swings" and ";" please insert -- so as to provide a plurality of indicators --.

Signed and Sealed this

Twenty-fifth Day of July, 2006

JON W. DUDAS
*Director of the United States Patent and Trademark Office*